US010871738B2

(12) United States Patent
Koehler et al.

(10) Patent No.: US 10,871,738 B2
(45) Date of Patent: Dec. 22, 2020

(54) FLICKER CONTROL

(71) Applicant: Hewlett-Packard Development Company, L.P., Spring, TX (US)

(72) Inventors: Duane A Koehler, Vancouver, WA (US); Robert Yraceburu, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/609,533

(22) PCT Filed: May 1, 2017

(86) PCT No.: PCT/US2017/030352

§ 371 (c)(1),
(2) Date: Oct. 30, 2019

(87) PCT Pub. No.: WO2018/203871

PCT Pub. Date: Nov. 8, 2018

(65) Prior Publication Data

US 2020/0073299 A1 Mar. 5, 2020

(51) Int. Cl.
*G03G 15/00* (2006.01)
*G03G 15/20* (2006.01)

(52) U.S. Cl.
CPC ..... *G03G 15/5004* (2013.01); *G03G 15/2039* (2013.01); *G03G 15/2064* (2013.01)

(58) Field of Classification Search
CPC ..... G03G 15/5004; G03G 15/80; G03G 15/2039; G03G 15/2064
See application file for complete search history.

(56) References Cited

U.S. PATENT DOCUMENTS

| | | | | |
|---|---|---|---|---|
| 5,789,723 | A | 8/1998 | Hirst | |
| 6,713,728 | B1 | 3/2004 | Justice et al. | |
| 7,573,206 | B2 | 8/2009 | Nicholson et al. | |
| 7,680,424 | B2 | 3/2010 | Hurst et al. | |
| 7,970,309 | B2 | 6/2011 | Sato et al. | |
| 2016/0357135 | A1* | 12/2016 | Yamamoto | G03G 15/2039 |
| 2017/0057250 | A1* | 3/2017 | Bastardas Puigoriol | B41J 29/377 |

FOREIGN PATENT DOCUMENTS

WO WO-2011070482 A2 6/2011

OTHER PUBLICATIONS

"Dummy Load for Led Lights / Eliminate Flickering (read 171660 Times)"; http://forum.micasaverde.com, Jan. 27, 2012—7 pages.

* cited by examiner

*Primary Examiner* — Carla J Therrien
(74) *Attorney, Agent, or Firm* — HP Inc. Patent Department

(57) ABSTRACT

An example system includes a varying resistive device, a controllable resistive device, a power supply to power the varying resistive device and the controllable resistive device, and a controller to control operation of the varying resistive device and the controllable resistive device. The varying resistive device changes a power level used during operation. The controller includes a flicker control portion, wherein the flicker control portion is to control a power level at the controllable resistive device based on changes in the power level used by the varying resistive device to maintain a flicker level below a predetermined flicker threshold.

20 Claims, 4 Drawing Sheets

FLICKER CONTROL

BACKGROUND

Various system, such as imaging devices are powered by plugging the system into an external power supply, such as by plugging into a wall outlet. Such systems may include various subsystems that are powered by the external power supply at different power levels. For example, a printer or other imaging system may have a printing engine subsystem, a media conditioning subsystem, and a finishing accessory subsystem.

BRIEF DESCRIPTION OF THE DRAWINGS

For a more complete understanding of various examples, reference is now made to the following description taken in connection with the accompanying drawings in which.

DETAILED DESCRIPTION

Various examples provide for mitigation of flicker that may be caused by a device or subsystem with, for example, frequent cycling between an on or off position or otherwise changing of power level used by the device or subsystem. For example, in an imaging system, a heated pressure roller (HPR) may use a heating lamp, such as a tungsten halogen lamp, to generate heat for the HPR. Due to tight tolerances for the temperature of the HPR, the heating lamp may be cycled between on and off frequently. The cycling of the heating lamp may cause a flickering, for example, in the lights of a building in which the imaging system is housed. In various examples, a second device or subsystem may be used as a ballast to reduce fluctuations in the power used. For example, in the imaging system using the HPR, an AC-powered dryer may be used in the print engine. In various examples, the dryer may be used as a ballast since the dryer may have greater tolerances. In one example, the dryer uses a nichrome wire heating element that has a longer thermal time constant than the HPR heating lamp. Thus, flicker may be mitigated or maintained below a predetermined threshold.

Figure 1:
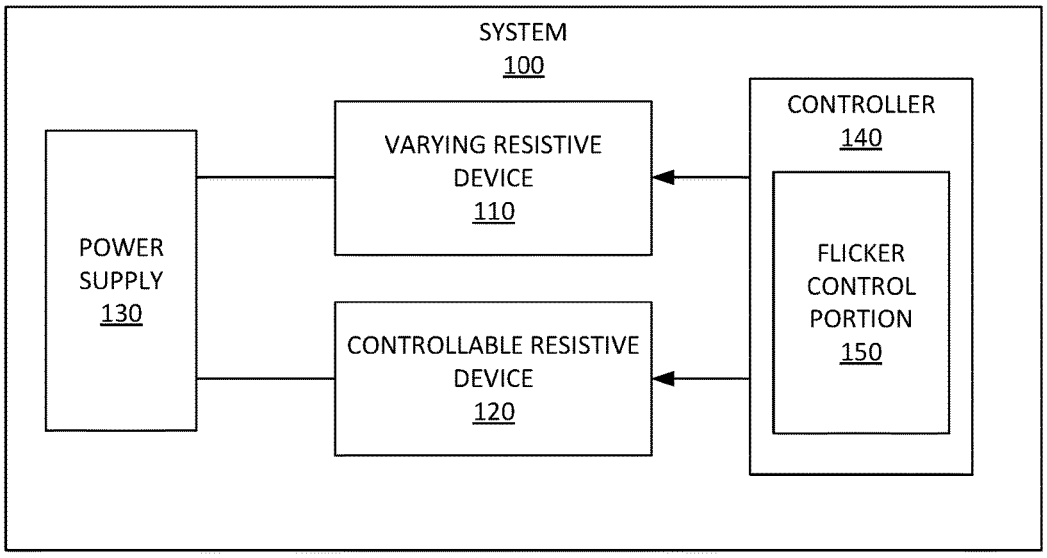
FIG. 1 provides a schematic illustration of an example system.

Referring now to the figures, FIG. 1 provides a schematic illustration of an example system 100. In various examples, the example system 100 of FIG. 1 may be an imaging system such as a printer, copier, scanner or a multi-function device. The example system 100 illustrated in FIG. 1 includes a varying resistive device 110. In some examples, the varying resistive device 110 changes a power level during operation of the varying resistive device 110. For example, while being operated, the varying resistive device 110 may alternate between an on state and an off state or change between low, medium or high level of operation, thus using a varying level of power. In the example in which the example system 100 is an imaging device, the varying resistive device 110 may be, for example, a heating lamp for a heated pressure roller (HPR) of the imaging system. In this regard, the level of power to the heating lamp may be changed to maintain the temperature of the HPR within a predetermined range. As described in greater detail below, a varying resistive device 110, such as a heating lamp, may be a short thermal time constant heating device.

The example system 100 of FIG. 1 further includes a controllable resistive device 120. As described below, a power level to the controllable resistive device 120 may be varied based on changes to the power level of the varying resistive device 110. In the example in which the example system 100 is an imaging device, the controllable resistive device 120 may be, for example, a dryer of the imaging system. As described in greater detail below, a controllable resistive device 110, such as a dryer, may be a long thermal time constant heating device.

The example system 100 of FIG. 1 is provided with a power supply 130 to power the varying resistive device 110 and the controllable resistive device 120. In various examples, the power supply 130 may include or be coupled to an AC power source. For example, the power supply 130 may include an AC cord to plug into a wall outlet of a building.

Operation of various components of the example system 100 of FIG. 1, such as the varying resistive device 110 and the controllable resistive device 120, may be controlled by a controller 140. In various examples, the controller 140 may be implemented as hardware, software, firmware or a combination thereof. The controller 140 may be a central processing unit (CPU) of the system 100, for example.

In the example system 100 of FIG. 1, the controller 140 includes a flicker control portion 150. The flicker control portion 150 controls the power level at the controllable resistive device 120 based on changes in the power level used by the varying resistive device 110 to maintain a flicker level below a predetermined flicker threshold. For example, the flicker control portion 150 may include logic to calculate a flicker level based on changes to the power level of the varying resistive device 110. As described above, frequent changes to the power level may cause lights in a building housing the system 100 to flicker at a level that may be perceptible to humans. In one example, if the flicker control portion 150 determines that the flicker level due to changes in the power level of the varying resistive device 110 is unacceptable (e.g., above a predetermined threshold), the flicker control portion 150 may cause the controllable resistive device to operate at a different power level to mitigate the flickering.

Figure 2:
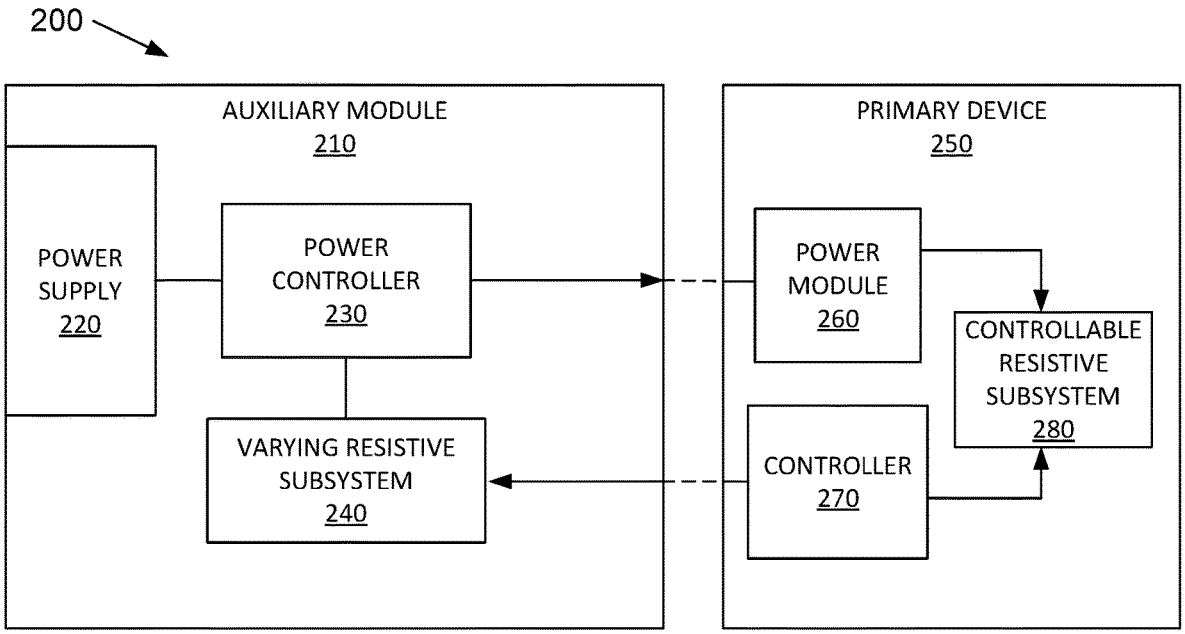
FIG. 2 provides a schematic illustration of another example system.

Referring now to FIG. 2, a schematic illustration of another example system 200 is provided. In various examples, the example system 200 includes an auxiliary module 210 that may be coupled to a primary device 250. In one example, the auxiliary module 210 is a conditioner that can be coupled to an imaging device, such as a printer. In various examples, a conditioner for an imaging device may be a system which changes certain properties of the print media, for example.

In the example system 200 of FIG. 2, the example auxiliary module 210 includes a power supply 220 that may be coupled to an external power source. In various examples, the power supply 220 includes an alternating current (AC) power cord, and the external power source may be an electrical outlet into which the AC power cord may be plugged.

The auxiliary module 210 includes a power controller 230 coupled to the power supply 220. In various examples, the power controller 230 includes circuitry to provide power from the external power source, through the power supply 220, to at least one subsystem, such as the varying resistive subsystem 240. In one example, the auxiliary module 210 is a conditioner for an imaging device, and the varying resistive subsystem 240 may include heat lamps for a heated pressure roller (HPR). Thus, the power controller 230 can provide power from the external source, such as a wall outlet, through the power supply 220 to the varying resistive subsystem 240.

Further, as indicated in the example of FIG. 2, the varying resistive subsystem 240 is to receive control signals from the primary device 250 to which the example auxiliary module 210 is coupled. In this regard, the varying resistive subsystem 240 of the example auxiliary module 210 may operate, at least in part, based on control signals from the primary device 250. For example, the lamps of the heated pressure roller may operate under the control of the imaging device to which the auxiliary module 210 (e.g., a conditioner) is coupled.

As noted above, in the example system 200, the example auxiliary module 210 is coupled to the primary device 250. The primary device 250 may be an imaging system, such as a printer, copier, fax machine, multi-function device or the like. The example primary device 250 of FIG. 2 includes a power module 260 to receive power from an external source. In this regard, an external source for the power module 260 is a power source that is external to the primary device 250. In the example system 200 of FIG. 2, the power module 260 is coupled to the power controller 230 of the example auxiliary module 210. In this regard, the power module 260 receives power, or power signals, from or through the power controller 230 of the example auxiliary module 210. For example, the power module 260 of the primary device 250 may include an AC plug, and the power controller 230 of the example auxiliary module 210 may include an AC outlet to receive the AC plug of the primary device 250.

The primary device 250 of FIG. 2 further includes a controller 270. The controller 270 provides control signals to at least one subsystem of the primary device 250, such as the controllable resistive subsystem 280 shown in FIG. 2. As noted above, in some examples, the primary device 250 is an imaging system. In such examples, the controllable resistive subsystem 280 may be a dryer subsystem for the imaging device, for example. The controller 270 may be provided to control operation of the controllable resistive subsystem 280 and/or other various subsystems provided in the primary device 250. Further, the controllable resistive subsystem 280 and/or other various subsystems of the primary device 250 may operate using power provided from the power module 260 of the primary device.

Figure 3:
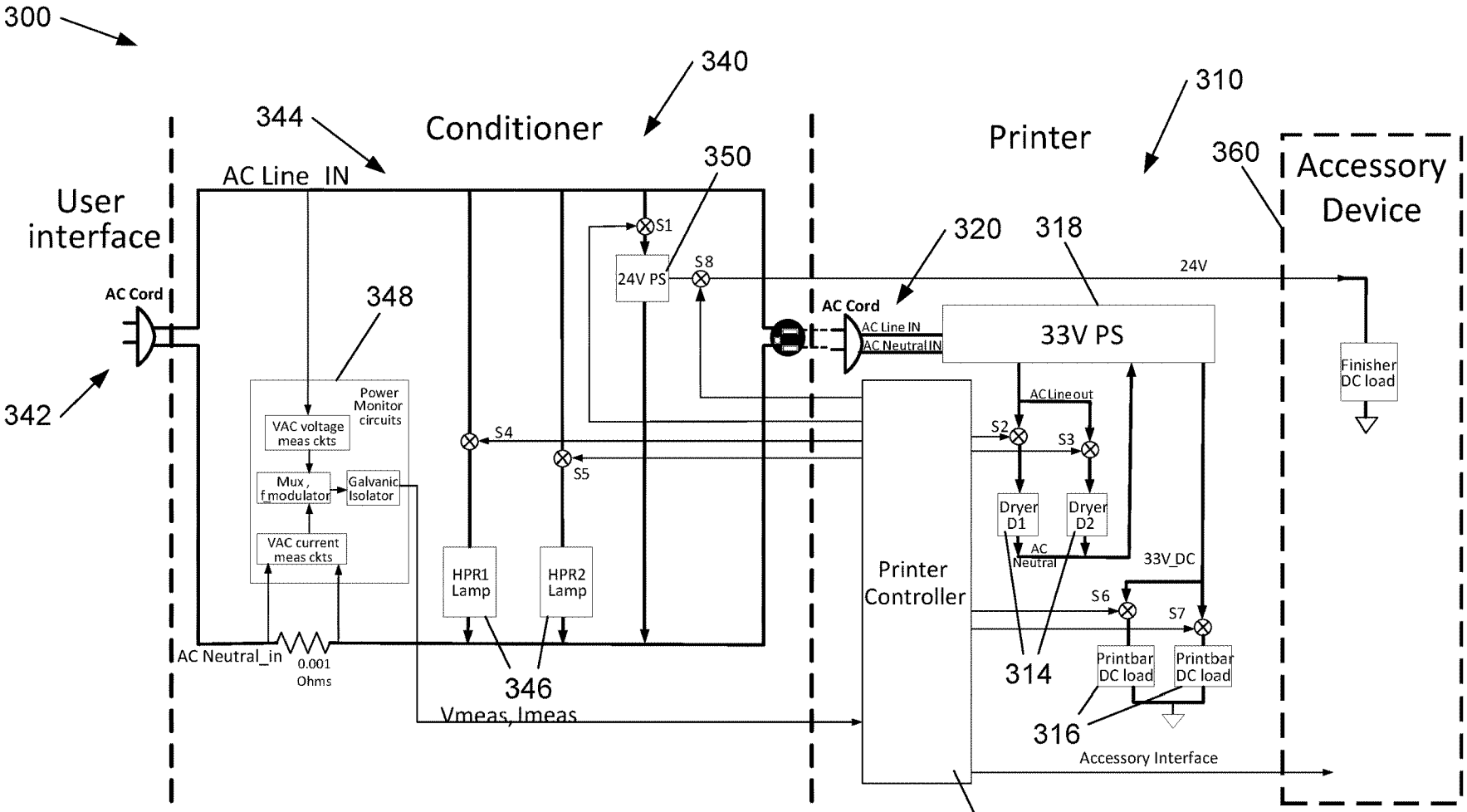
FIG. 3 illustrates a circuit diagram of an example system.

Referring now to FIG. 3, a circuit diagram of an example system 300 is illustrated. The example system 300 includes a printer 310 which includes a printer controller 312. The printer controller 312 controls operation of the printer 310, including various subsystems of the printer 310, as well as operation of any auxiliary or accessory devices coupled to the printer 310. In the example system 300 of FIG. 3, the printer 310 includes a dryer subsystem 314 and a printbar subsystem 316.

The printer 310 of the example system 300 further includes a power system 318. In the example system 300 of FIG. 3, the power system 318 of the printer 310 includes a 33-volt power supply which is coupled to a power source that is external to the printer 310. The power system 318 controls distribution of power to the various subsystems of the printer 310. As illustrated in the example of FIG. 3, the 33-volt power supply may provide AC power to the dryer subsystem 314 and DC power to the printbar subsystem 316. The power system 318 of the printer 310 is coupled to an external power source through an interface, such as an AC power cord 320.

As noted above, the printer controller 312 controls operation of the various subsystems. In this regard, in the example system 300 of FIG. 3, the printer controller 312 may transmit signals S2, S3 to the dryer subsystem 314 and signals S6, S7 to the printbar subsystem 316.

The example system 300 further includes an auxiliary module in the form of a conditioner 340 coupled to the printer 310. In some examples, the conditioner 340 may be positioned above a print engine of an imaging device, such as the printer 310, for example. The conditioner may be coupled to an external power source through, for example, an AC power cord 342. In various examples, the AC power cord 342 of the conditioner 340 may be plugged into a wall outlet (not shown) or other external power source for AC power. In one example, the external power source is a 15 amp AC power source.

The conditioner 340 of the example system 300 includes circuitry 344 to distribute power from the external power source, through the AC power cord 342, to various subsystems of the conditioner 340. For example, in the example illustrated in FIG. 3, the circuitry 344 allows distribution of power to a heated power roller (HPR) subsystem which includes HPR lamps 346. In the example system 300 of FIG. 3, the circuitry 344 provides a 24-volt power source to power the HPR subsystem and/or various other subsystems of the conditioner 340.

The HPR subsystem and/or various other subsystems of the conditioner 340 operate under the control of the printer controller 312 of the printer 310. In this regard, in the example system 300 of FIG. 3, the printer controller 312 may transmit signals S4, S5 to the HPR lamps 346 of the HPR subsystem.

The conditioner 340 of the example system 300 of FIG. 3 further includes power monitor circuits 348 to measure various voltages, currents and/or other parameters related to power. As illustrated by the arrow in FIG. 3, various measurements from the power monitor circuits 348 are transmitted from the conditioner 340 to the printer controller 312 of the printer 310. In this regard, the printer controller 312 may use the power information as factors in operation of various subsystems of the printer 310 and the conditioner 340. For example, the printer controller 312 may vary operation to avoid overload of power systems or to reduce flicker.

The example system 300 further includes an accessory device 360, which may be a finisher for the printer 310. In one example, the accessory device 360 may be a floor-standing device that is separate from the printer 310 and is connected, for example, via at least one cable (e.g., USB cable). In the example system 300 of FIG. 3, the accessory device 360 receives control signals from the printer controller 312 of the printer. Power for operation of the accessory device 360 in the example system 300 is provided through the conditioner 340. For example, as illustrated in FIG. 3, power for operation of the accessory device 360 is provided through the circuitry 344 of the conditioner via a 24-volt power supply 350. In the example of FIG. 3, the power is supplied to a finisher, which may represent a 24-volt DC load.

In one example, the HPR lamps 346 are tungsten halogen lamps to generate heat for the HPR. In one example, the HPR lamps 346 include two lamps of 600 and 700 watts. The lamps 346 may be used to maintain a tight temperature tolerance for the HPR. In this regard, the lamps 346 may be cycled on and off. The HPR may have a relatively short thermal time constant. Accordingly, the cycle time for the lamps 346 may be short, such as less than one second, for example. The short cycle time may cause flicker in the lights in the electrical system outside the system 400.

In various examples, the dryer 314 may be used as ballast to reduce the flicker. In one example, the dryer 314 uses a nichrome wire heating element inside an enclosure. In this regard, the dryer 314 may have a relatively long thermal time constant. In one example, the dryer 314 includes two dryers that may operate at a maximum power of 500 watts each. The dryer may operate at 50 Hz AC and may use half-cycle control to control the temperature of the dryer. Thus, the dryer 314 may be operated with 100 opportunities each second during which power may be supplied or withheld from the dryer 314. In order to reduce flicker, the duty cycle of the dryer 314 may be adjusted based on changes to the power level of the HPR lamps to mitigate flicker. In this regard, the dryer 314 serves as ballast, and no power is wasted.

Figure 4:
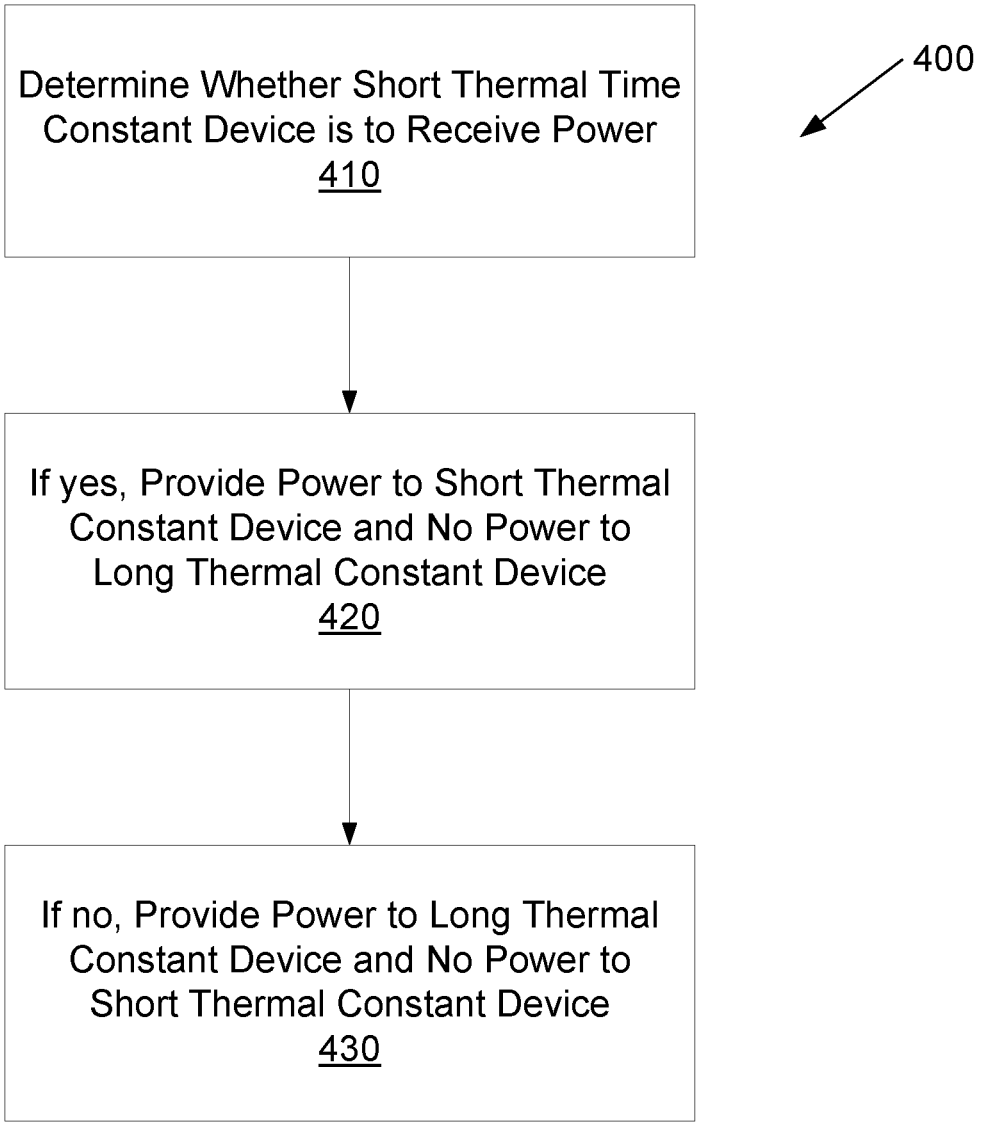
FIG. 4 is a flow chart illustrating an example method for flicker control.

Referring now to FIG. 4, a flow chart illustrates an example method for flicker control. The example method 400 may be implemented in a controller, such as the controller 312 of the printer 310 described above with reference to FIG. 3. In the example method 400 of FIG. 4, received determination is made as to whether a short thermal constant device is to receive power in a current power cycle (block 410). For example, with reference to FIG. 3, the printer controller 312 may determine whether the HPR lamps 346 are to receive power in the current power cycle. In this regard, the current power cycle may be each half-cycle of the AC power supply. Further, the determination may be based on a temperature measurement of the HPR. As in the examples described above, the short thermal constant device is coupled to the same power supply as a large thermal time constant device. For example, in the example of FIG. 3, the power system 344 is coupled to the HPR lamps 346 (short thermal time constant device) and the dryer 314 (large thermal time constant device). In the example method 400 of FIG. 4, if the determination at block 410 is made that the short thermal time constant device is to receive power, power is directed to the short thermal constant device, and no power is directed to the long thermal constant device (block 420). Further, if the determination at block 410 is made that the short thermal time constant device is to not receive power, power is directed to the long thermal constant device, and no power is directed to the short thermal constant device (block 420). In this manner, a smooth power load may be maintained to avoid or mitigate flicker events.

Figure 5:
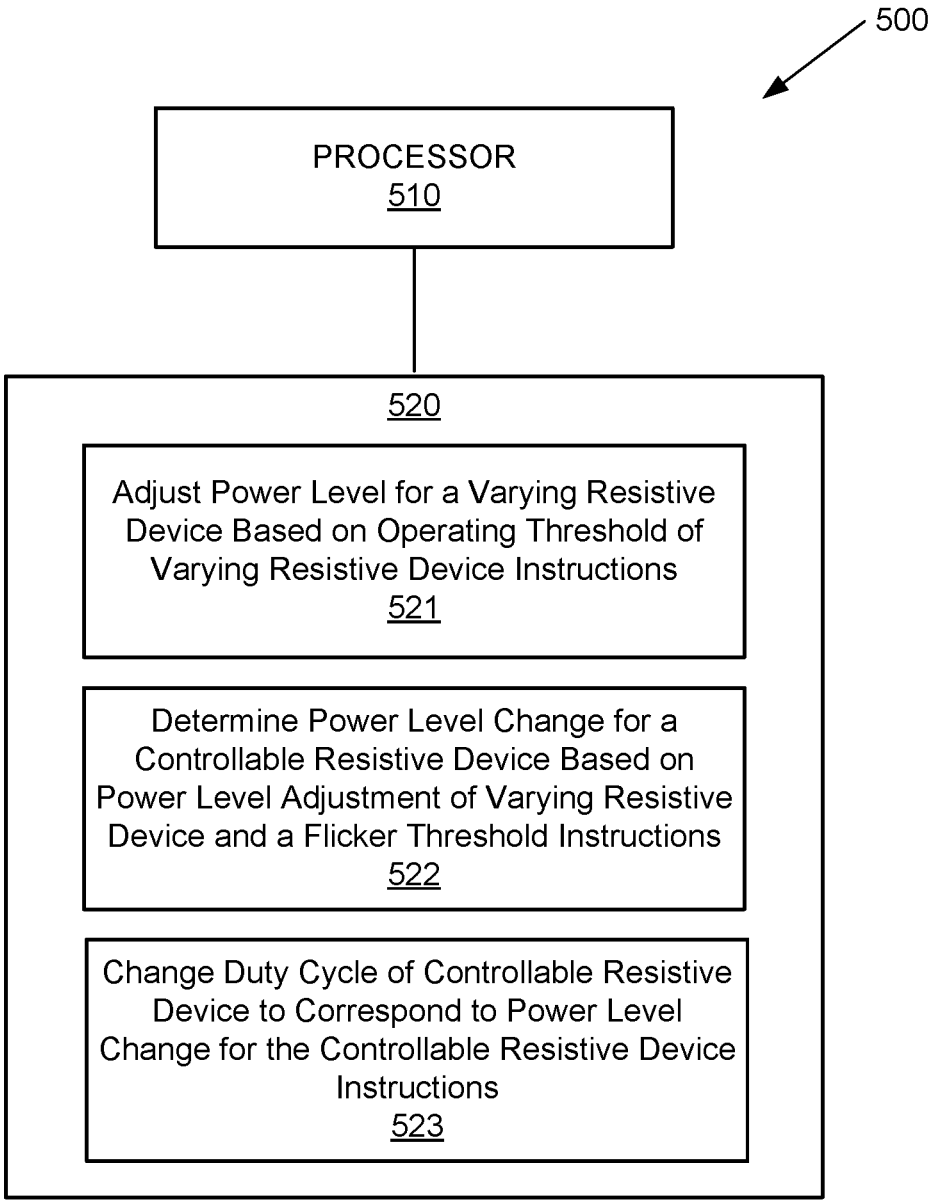
FIG. 5 illustrates a block diagram of an example system with a computer-readable storage medium including instructions executable by a processor for flicker control.

Referring now to FIG. 5, a block diagram of an example system is illustrated with a non-transitory computer-readable storage medium including instructions executable by a processor for flicker control. The system 500 includes a processor 510 and a non-transitory computer-readable storage medium 520. The computer-readable storage medium 520 includes example instructions 521-523 executable by the processor 510 to perform various functionalities described herein. In various examples, the non-transitory computer-readable storage medium 520 may be any of a variety of storage devices including, but not limited to, a random access memory (RAM) a dynamic RAM (DRAM), static RAM (SRAM), flash memory, read-only memory (ROM), programmable ROM (PROM), electrically erasable PROM (EEPROM), or the like. In various examples, the processor 510 may be a general purpose processor, special purpose logic, or the like.

The example instructions include adjust a power level for a varying resistive device based on operating threshold of the varying resistive device instructions 521. For example, as noted above with reference to FIG. 3, the operating power level of the HPR lamps 346 may be adjusted to maintain the temperature of the HPR within tight tolerances (or thresholds). The example instructions further include determine a power level change for a controllable resistive device based on adjustment of the power level for the varying resistive device and a flicker threshold instructions 522. As noted with reference to the example of FIGS. 3 and 4, the printer controller 312 may calculate a new power level for the dryer 314 based on the power level change of the HPR lamp 346 and a predetermined flicker threshold. The example instruction further include change duty cycle of the controllable resistive device to correspond to the power level change for the controllable resistive device instructions 523. With reference to the example of FIG. 3, the printer controller 312 may change the duty cycle of the dryer 314 to change the power level of the dryer 314.

Thus, various examples described herein can mitigate flicker cause by frequent power level changes of one subsystem. Using a second subsystem as a ballast allows mitigating of the flicker without waste of power.

Software implementations of various examples can be accomplished with standard programming techniques with rule-based logic and other logic to accomplish various database searching steps or processes, correlation steps or processes, comparison steps or processes and decision steps or processes.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system, comprising:

a varying resistive device comprising a component of an auxiliary module, wherein the varying resistive device changes a power level used during operation;

a controllable resistive device comprising a component of an imaging device separate from the auxiliary module;

a power supply to power the varying resistive device and the controllable resistive device; and a controller of the imaging device to control operation of the varying resistive device and the controllable resistive device, the controller including a flicker control portion, wherein the flicker control portion is to control a power level at the controllable resistive device based on changes in the power level used by the varying resistive device to maintain a flicker level below a predetermined flicker threshold.

2. The system of claim 1, wherein the flicker control portion is to change a duty cycle of the controllable resistive device to maintain the flicker level below the predetermined flicker threshold.

3. The system of claim 1, wherein the varying resistive device is a heating lamp for a heated pressure roller of an imaging system.

4. The system of claim 3, wherein the heating lamp is a tungsten halogen lamp to generate heat for the heated pressure roller.

5. The system of claim 3, wherein the power level for the varying resistive device is changed to maintain a temperature of the heated pressure roller within a predetermined range.

6. The system of claim 3, wherein the controllable resistive device is a dryer for the imaging device utilized in a drying operation separate from a heating operation of the heating lamp.

7. The system of claim 1, wherein the auxiliary module is coupled to an external power source, and wherein an AC plug of the imaging device is coupled to an AC outlet of the auxiliary module.

8. The system of claim 1, further comprising a power monitor circuit of the auxiliary module to measure changes in the power level used by the varying resistive device and transmit the changes to the controller of the imaging device to calculate a power level adjustment to the controllable resistive device.

9. The system of claim 1, wherein the controller of the imaging device controls the varying resistive device utilizing a first control signal sent to the auxiliary module, wherein the controller of the imaging system controls the controllable resistive device utilizing a second control signal sent to a dryer subsystem of the imaging device, and wherein the controller of the imaging device controls a printbar utilizing a third control signal sent to a dryer subsystem of the imaging device.

10. A method, comprising:

determining whether a short thermal time constant device of an auxiliary module is to receive power in a current power cycle, wherein the short thermal time constant device is coupled to a common power supply with a long thermal time constant device of an imaging device separate from but connected to the auxiliary module;

each time the short thermal time constant device is determined to receive power in the current power cycle, providing power to the short thermal time constant device and no power to the long thermal time constant device; and each time the short thermal time constant device is determined to not receive power in the current power cycle, providing power to the long thermal time constant device and no power to the short thermal time constant device.

11. The method of claim 10, wherein the determining whether the short thermal time constant device is to receive power includes receiving a temperature measurement associated with the short thermal time constant device.

12. The method of claim 10, wherein the short thermal time constant device is a heating lamp for a heated pressure roller of an imaging system.

13. The method of claim 12, wherein the heating lamp is a tungsten halogen lamp to generate heat for the heated pressure roller.

14. The method of claim 12, wherein the long thermal time constant device is a dryer for the imaging device.

15. A non-transitory computer-readable storage medium encoded with instructions executable by a processor of a computing system, the computer-readable storage medium comprising instructions to:

adjust a power level for a varying resistive device based on an operating threshold of the varying resistive device, wherein the varying resistive device is a component of a conditioning system;

determine a power level change for a controllable resistive device based on adjustment of the power level for the varying resistive device and a flicker threshold, wherein the controllable resistive device is a component of an imaging device separate from the conditioning system; and change duty cycle of the controllable resistive device to correspond to the power level change for the controllable resistive device.

16. The non-transitory computer-readable storage medium of claim 15, wherein the varying resistive device is a heating lamp for a heated pressure roller of the imaging system.

17. The non-transitory computer-readable storage medium of claim 16, wherein the heating lamp is a tungsten halogen lamp to generate heat for the heated pressure roller.

18. The non-transitory computer-readable storage medium of claim 16, wherein the controllable resistive device is a dryer for the imaging device.

19. The non-transitory computer-readable storage medium of claim 15, wherein controllable resistive device is operated as a ballast to be provided power during a power cycle whenever the varying resistive device is not provided power during the power cycle.

20. The non-transitory computer-readable storage medium of claim 15, wherein the conditioning system is positioned above a print engine of the imaging device.

* * * * *